US010515730B2

(12) United States Patent
Singh et al.

(10) Patent No.: US 10,515,730 B2
(45) Date of Patent: Dec. 24, 2019

(54) APPARATUS FOR STORING AND/OR TRANSPORTING RADIOACTIVE MATERIALS

(71) Applicant: HOLTEC INTERNATIONAL, Camden, NJ (US)

(72) Inventors: Krishna P. Singh, Hobe Sound, FL (US); Paul Stefan Anton, South Hampton, NJ (US); Robert Mahorter, Marlton, NJ (US)

(73) Assignee: HOLTEC INTERNATIONAL, Camden, NJ (US)

( * ) Notice: Subject to any disclaimer, the term of this patent is extended or adjusted under 35 U.S.C. 154(b) by 0 days.

(21) Appl. No.: 16/086,961

(22) PCT Filed: Mar. 16, 2017

(86) PCT No.: PCT/US2017/022648
§ 371 (c)(1),
(2) Date: Sep. 20, 2018

(87) PCT Pub. No.: WO2017/165180
PCT Pub. Date: Sep. 28, 2017

(65) Prior Publication Data

US 2019/0103197 A1 Apr. 4, 2019

Related U.S. Application Data

(60) Provisional application No. 62/311,540, filed on Mar. 22, 2016.

(51) Int. Cl.
*G21F 5/005* (2006.01)
*G21F 5/08* (2006.01)
(Continued)

(52) U.S. Cl.
CPC ..... *G21F 5/005* (2013.01); *G21F 5/08* (2013.01); *G21F 5/10* (2013.01); *G21F 5/12* (2013.01); *G21F 9/34* (2013.01)

(58) Field of Classification Search
None
See application file for complete search history.

(56) References Cited

U.S. PATENT DOCUMENTS 3,206,367 A 9/1965 Peuchmaur et al.
4,649,018 A 3/1987 Waltersdorf et al.
(Continued)

FOREIGN PATENT DOCUMENTS

JP 2009-300251 A 12/2009
JP 2010-175331 A 8/2010

OTHER PUBLICATIONS

International Search Report for Corresponding Application No. PCT/US17/22648, dated Jun. 9, 2017. WO.
(Continued)

*Primary Examiner* — Andrew Smyth
(74) *Attorney, Agent, or Firm* — The Belles Group, P.C.

(57) ABSTRACT

A ventilated apparatus for storing and/or transporting high level radioactive waste. In one aspect, the invention is a ventilated apparatus comprising: an overpack body having an inner surface forming a cavity about a longitudinal axis. A bottom portion of the overpack body is formed by a plurality of segments. Each of the segments extends from a first end wall having a projection to a second end wall having a channel. The segments circumferentially surround a longitudinal axis and are arranged in an intermeshing and spaced-apart configuration such that the projections of the first end walls of the segments project into the channels of the second end walls of adjacent ones of the segments, thereby forming inlet ducts between adjacent ones of the
(Continued)

segments. The inlet ducts form air inlet passageways from the external atmosphere to a bottom portion of the cavity.

16 Claims, 12 Drawing Sheets

(51) Int. Cl.
*G21F 5/10* (2006.01)
*G21F 5/12* (2006.01)
*G21F 9/34* (2006.01)

(56) References Cited

U.S. PATENT DOCUMENTS 4,834,916 A * 5/1989 Chaudon ..... G21C 19/06 250/506.1
5,564,498 A * 10/1996 Bochard ..... G21C 15/12 165/169
6,519,307 B1 * 2/2003 Singh ..... G21F 5/10 250/506.1
6,538,259 B2 3/2003 Matsunaga et al.
7,590,213 B1 * 9/2009 Singh ..... G21F 5/00 376/274
2003/0028065 A1 * 2/2003 Matsunaga ..... G21F 5/008 588/16
2003/0147486 A1 * 8/2003 Singh ..... G21C 19/06 376/272
2004/0067328 A1 * 4/2004 Taniuchi ..... C04B 22/0013 428/34.4
2005/0213698 A1 * 9/2005 Morishige ..... G21F 5/005 376/272
2005/0220257 A1 * 10/2005 Singh ..... G21C 19/06 376/272
2005/0224729 A1 * 10/2005 Tamaki ..... G21F 5/00 250/507.1
2006/0215803 A1 * 9/2006 Singh ..... G21F 5/002 376/272
2006/0219960 A1 * 10/2006 Shimojo ..... G21F 1/04 250/518.1
2008/0031397 A1 2/2008 Singh et al.
2010/0284506 A1 * 11/2010 Singh ..... G21F 5/005 376/272
2012/0037632 A1 * 2/2012 Singh ..... G21F 5/005 220/367.1
2014/0247916 A1 * 9/2014 Singh ..... G21F 5/06 376/272
2014/0270042 A1 * 9/2014 Dederer ..... G21C 19/07 376/272
2014/0329455 A1 * 11/2014 Singh ..... G21F 5/005 454/237
2015/0211954 A1 * 7/2015 Agace ..... G21F 5/005 250/282
2016/0035446 A1 * 2/2016 Cheng ..... G21F 5/008 376/272
2016/0196887 A1 * 7/2016 Singh ..... G21F 5/008 220/592.01

OTHER PUBLICATIONS

CN First Office Action—Search Report, dated Dec. 18, 2018 by the Chinese Patent Office, Corresponding Family CN Application No. 2017800001612, Office Action pp. 1-4 and Search Report pp. 1-2.

* cited by examiner

APPARATUS FOR STORING AND/OR TRANSPORTING RADIOACTIVE MATERIALS

CROSS-REFERENCE TO RELATED PATENT APPLICATIONS

The present application is a U.S. national phase application under 35 U.S.C. § 371 of International Patent Application No. PCT/US17/22648 filed Mar. 16, 2017, which claims the benefit of U.S. Provisional Patent Application Ser. No. 62/311,540, filed Mar. 22, 2016, the entireties of which are hereby incorporated by reference.

FIELD OF THE INVENTION

The present invention relates generally to an apparatus for storing and/or transporting radioactive materials, and specifically to a ventilated apparatus for storing and/or transporting radioactive materials that utilizes natural convection cooling.

BACKGROUND OF THE INVENTION

In the operation of nuclear reactors, it is customary to remove fuel assemblies after their energy has been depleted down to a predetermined level. Upon removal, the spent nuclear fuel (hereinafter, "SNF") is still highly radioactive and produces considerable heat, requiring that great care be taken in its packaging, transporting, and storing. In order to protect the environment from radiation exposure, SNF is first placed in a hermetically sealed canister that creates a confinement boundary about the SNF. The loaded canister is then transported and stored in a large cylindrical container called a cask. Generally, a transfer cask is used to transport SNF from location to location while a storage cask is used to store SNF for a determined period of time.

One type of storage cask is a ventilated vertical overpack ("VVO"). A VVO is a massive structure made principally from steel and concrete and is used to store a canister loaded with SNF. In using a VVO to store SNF, a canister loaded with SNF is placed in the cavity of the body of the VVO. Because the SNF is still producing a considerable amount of heat when it is placed in the VVO for storage, it is necessary that the cavity is vented so that this heat energy has a means to escape from the VVO cavity. It is also imperative that the VVO provide adequate radiation shielding and that the SNF not be directly exposed to the external environment. Thus, a need exists for a VVO system for the storage of radioactive materials that provides enhanced ventilation, reduces the likelihood of radiation exposure, and provides sufficient radiation blockage of both gamma and neutron radiation emanating from the high level radioactive waste.

SUMMARY OF THE INVENTION

The present invention, in one aspect, is a ventilated apparatus having specially designed inlet ducts that allow a canister loaded with SNF (or other radioactive materials) to be positioned within the ventilated apparatus so that a bottom end of the canister is below a top of the inlet ducts while still preventing radiation from escaping through the inlet ducts. This aspect of the present invention allows the ventilated apparatus to be designed with a minimized height because the canister does not have to be supported in a raised position above the inlet ducts within the cavity of the ventilated apparatus. Thus, it is possible for the height of the cavity of the ventilated apparatus to be approximately equal to the height of the canister, with the addition of the necessary tolerances for thermal growth effects and to provide for an adequate ventilation space above the canister.

In one embodiment, the invention can be ventilated apparatus for transporting and/or storing radioactive materials comprising: an overpack body having an outer surface and an inner surface forming an internal cavity about a longitudinal axis; a base enclosing a bottom end of the cavity; a lid enclosing a top end of the cavity; a plurality of outlet ducts, each of the outlet ducts forming an air outlet passageway from a top portion of the cavity to an external atmosphere; a bottom portion of the overpack body formed by a plurality of curved segments, each of the curved segments extending circumferentially from a first end wall having a convex portion to a second end wall having a concave portion; and the curved segments circumferentially surrounding the longitudinal axis and arranged in an intermeshing configuration such that for all adjacent curved segments: (1) the convex portion of the first end wall of one of the curved segments at least partially nests within the concave portion of the second end wall of an adjacent one of the curved segments; and (2) the convex portion of the first end wall of the one of the curved segments is spaced from the concave portion of the second end wall of the adjacent one of the curved segments, thereby forming an inlet duct forming an air inlet passageway from the external atmosphere to a bottom portion of the cavity.

In another embodiment, the invention can be a ventilated apparatus for transporting and/or storing radioactive materials comprising: an overpack body having an outer surface and an inner surface forming an internal cavity about a longitudinal axis; a base enclosing a bottom end of the cavity; a lid enclosing a top end of the cavity; a plurality of outlet ducts, each of the outlet ducts forming an air outlet passageway from a top portion of the cavity to an external atmosphere; a bottom portion of the overpack body formed by a plurality of segments, each of the segments extending from a first end wall having a projection to a second end wall having a channel; and the segments circumferentially surrounding the longitudinal axis and arranged in an intermeshing and spaced-apart configuration such that the projections of the first end walls of the segments project into the channels of the second end walls of adjacent ones of the segments, thereby forming an inlet duct between adjacent ones of the segments that includes an air inlet passageway from the external atmosphere to a bottom portion of the cavity through which a line of sight does not exist from the cavity to the external atmosphere.

In yet another aspect, the invention can be a ventilated apparatus for transporting and/or storing radioactive materials comprising: an overpack body having an outer surface, an inner surface forming an internal cavity about a longitudinal axis, and a top surface; a base enclosing a bottom end of the cavity; a plurality of air inlet ducts, each of the air inlet ducts forming an air inlet passageway from an external atmosphere to a bottom portion of the cavity; and a lid enclosing a top end of the cavity, the lid configured so that a plurality of air outlet passageways are at least partially defined by an interface between the lid and the top surface of the overpack body, each of the air outlet passageways extending from a top portion of the cavity to the external atmosphere.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The features of the preferred embodiments will be described with reference to the following drawings where like elements are labeled similarly, and in which.

DETAILED DESCRIPTION OF THE DRAWINGS

Figure 1:
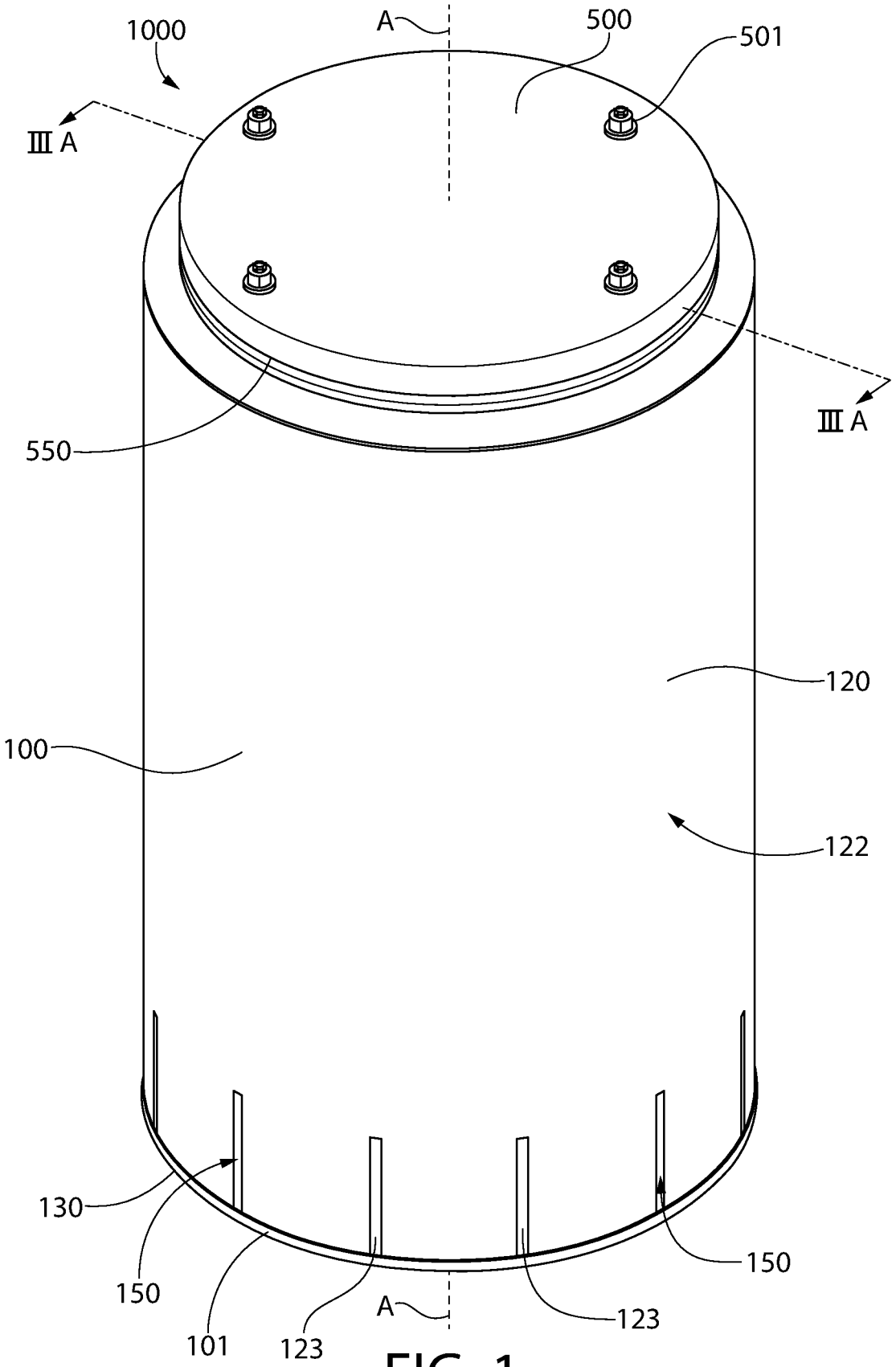
FIG. 1 is a top perspective view of ventilated apparatus according to an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring to FIGS. 1-3B concurrently, a ventilated apparatus 1000 is illustrated according to an embodiment of the present invention. The ventilated apparatus 1000 is a vertical, ventilated, dry, SNF storage system that is fully compatible with 100 ton and 125 ton transfer casks for spent fuel canister transfer and storage operations. The ventilated apparatus 1000 can, of course, be modified and/or designed to be compatible with any size or style of transfer cask. Moreover, while the ventilated apparatus 1000 is discussed herein as being used to store SNF, it is to be understood that the invention is not so limited and that, in certain circumstances, the ventilated apparatus 1000 can be used to transport SNF from location to location if desired. Moreover, the ventilated apparatus 1000 can be used in combination with any other type of high level radioactive waste. The ventilated apparatus 1000 may in certain embodiments be a ventilated vertical overpack.

The ventilated apparatus 1000 is designed to accept a canister for storage at an Independent Spent Fuel Storage Installation ("ISFSI"). All canister types engineered for the dry storage of SNF can be stored in the ventilated apparatus 1000. Suitable canisters include multi-purpose canisters ("MPCs") and, in certain instances, can include thermally conductive casks that are hermetically sealed for the dry storage of high level radioactive waste. Typically, such canisters comprise a honeycomb basket or other structure to accommodate a plurality of SNF rods in spaced relation.

The ventilated apparatus 1000 comprises two major parts: (1) a dual-walled cylindrical overpack body 100 which comprises a set of inlet ducts 150 at or near its bottom extremity and an integrally welded baseplate 130; and (2) a removable top lid 500. In some embodiments, the removable top lid 500 may be equipped with at least one, or a plurality of, outlet ducts 550. However, as described herein below with reference to FIGS. 8A-8C, the invention is not to be so limited and the outlet ducts 550 may not be formed entirely by the lid 500 but may instead be formed by the interface of the lid 550 and the overpack body 100. The overpack body 100 forms an internal cavity 10 about a longitudinal axis A-A of sufficient height and diameter for housing an MPC 200 fully therein. The ventilated apparatus 1000 is designed so that the internal cavity 10 has a minimized height that corresponds to a height of the MPC 200 which is to be stored therein. Moreover, the cavity 10 preferably has a horizontal (i.e., transverse to the longitudinal axis A-A) cross-section that is sized to accommodate only a single MPC 200.

The overpack body 100 extends from a bottom end 101 to a top end 102. The base plate 130 is connected to the bottom end 101 of the overpack body 100 so as to enclose the bottom end of the cavity 10. An annular plate or shear ring 140 is connected to the top end 102 of the overpack body 100. The shear ring 140 is a ring-like structure preferably formed from metal (i.e., steel) while the base plate 130 is a thick solid disk-like plate. The base plate 130 hermetically closes the bottom end 101 of the overpack body 100 (and the cavity 10) and forms a floor for the cavity 10 upon which a canister or MPC can rest as described herein below.

The overpack body 100 comprises an inner shell 110 and an outer shell 120. The inner shell 110 has an inner surface 111 and an outer surface 112. The inner surface 111 of the inner shell 110 forms the inner surface of the overpack body 100 and defines or bounds the internal cavity 10 of the overpack body 100. The outer shell 120 has an inner surface 121 that faces the outer surface 112 of the inner shell 110 in a spaced apart manner and an outer surface 122 that forms the outer surface of the overpack body 100. In certain embodiments, each of the inner and outer shells 110, 120 is formed of metal, such as for example without limitation carbon steel or the like. The inner and outer shells 110, 120 are annularly spaced apart from one another. Specifically, the inner and outer shells 110, 120 are concentrically arranged so that a gap 105 exists between the outer surface 112 of the inner shell 110 and the inner surface 121 of the outer shell 120. The shear ring 140 mentioned above extends from a top end of the outer shell 120 inwardly towards the inner shell 110 and the longitudinal axis A-A. However, the shear ring 140 stops short of the inner shell 110 and thus it is connected only to the outer shell 120 and not also to the inner shell 110. Thus, a gap 141 remains between the shear ring 140 and the inner shell 110.

By virtue of its geometry, in the exemplified embodiment the overpack body 100 is a rugged, heavy-walled cylindrical vessel. The main structural function of the overpack body is provided by its carbon steel components (the inner and outer shells 110, 120) while the main radiation shielding function is provided by an annular concrete mass 115 that fills in the gap 105 between the inner and outer shells 110, 120. The concrete mass 115 may comprise common cement, a chemically inert aggregate of a suitable density, and a specially selected hydrogen-rich additive. In addition, boron carbide powder may be added to the mix that forms the concrete mass 115 if it is desired to reduce neutron flux to the environment to infinitesimal levels. Boron carbide may be added in powder form or as chips of a metallic neutron absorber such as Metamic. Additional additives that may be included in the mix are vinyl, nylon, and similar hydrogen-rich polymers that are commercially available in granular form and that don't react with concrete or water and are stable at temperatures up to approximately 170° F. The polymeric additives in the concrete may be preferentially concentrated in the outer region of the annulus where the temperature of the concrete during service conditions is lower. The quantity of the hydrogenous additive may be varied to tailor the neutron blockage capability (effectiveness) required of the ventilated apparatus 1000. Both the hydrogen-rich compound and boron carbide are optional additives.

Figure 2A:
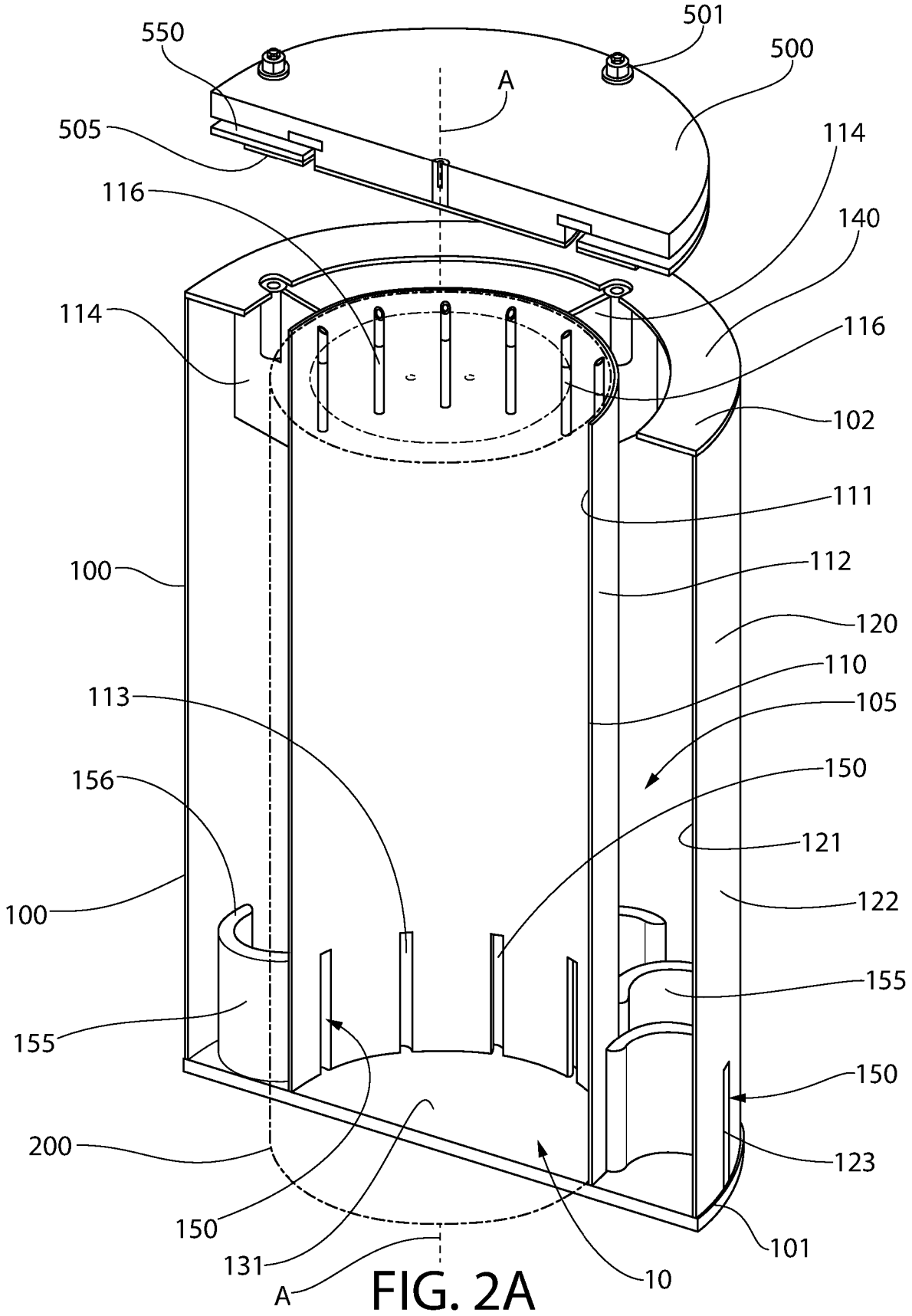
FIG. 2A is a top perspective view of the ventilated apparatus of FIG. 1 illustrating an overpack body having its lid removed and a canister, illustrated in broken lines, positioned in a cavity of the overpack body, wherein a section of the overpack body is cut-away to facilitate viewing.
Figure 2B:
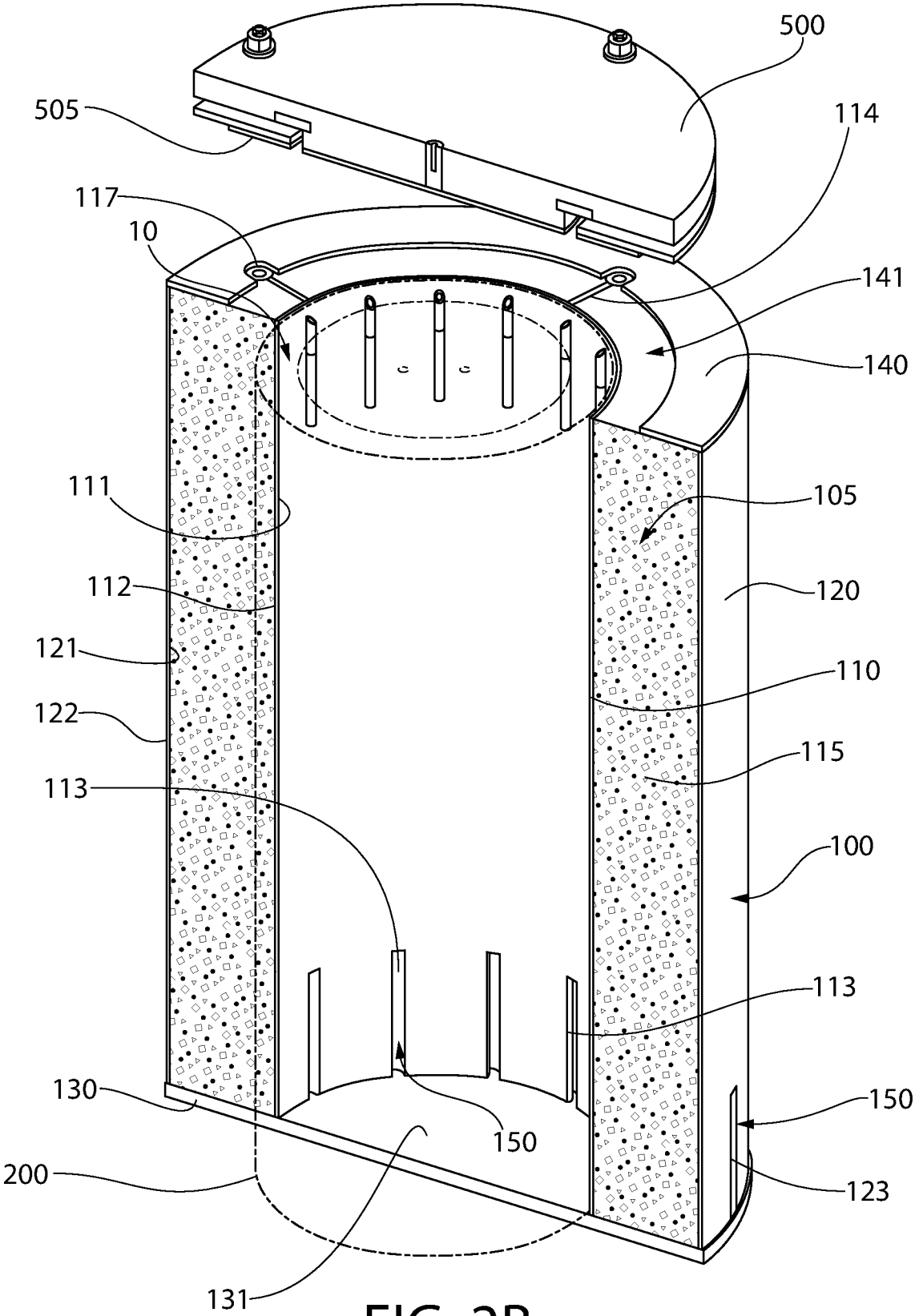
FIG. 2B is the same view as FIG. 2A except that a space between an inner and outer shell of the overpack body is filled with concrete.
Figure 9:
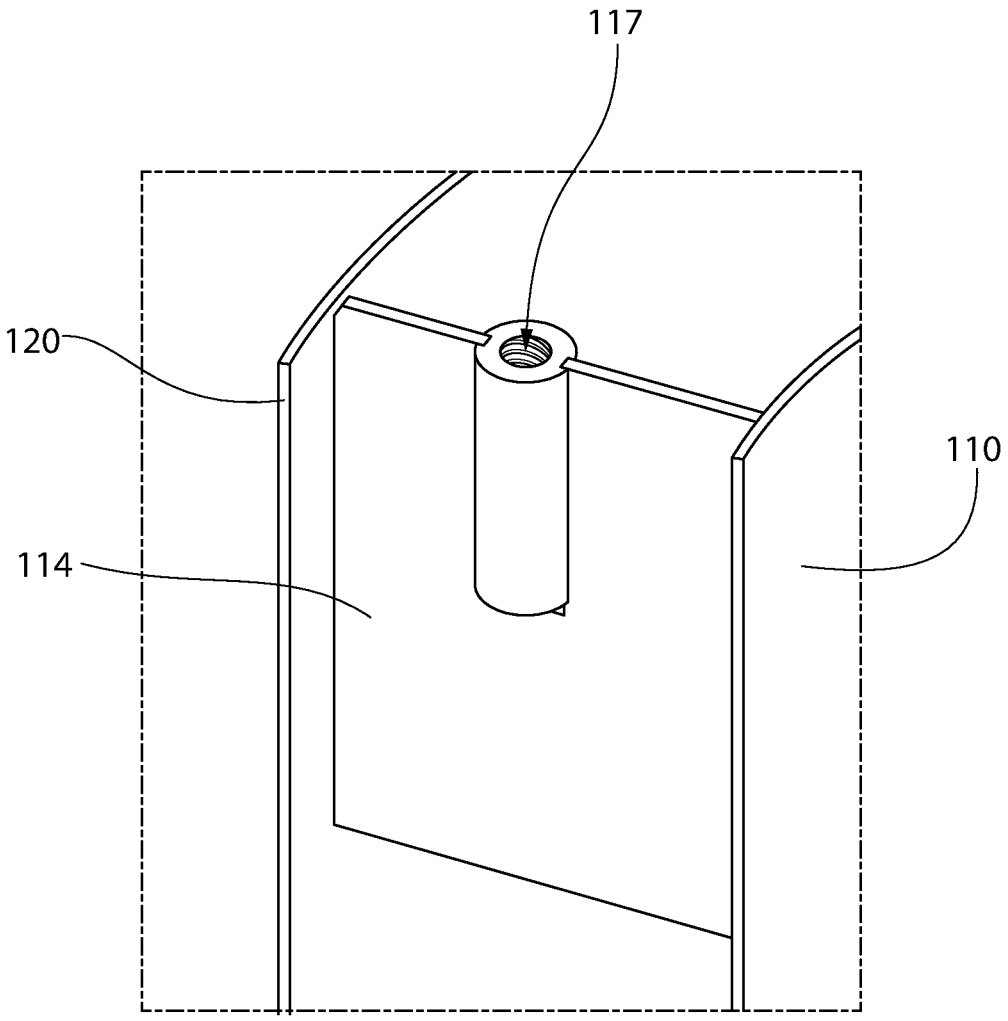
FIG. 9 is a close-up view of an anchor block of the overpack body in accordance with an embodiment of the present invention.

As illustrated in FIG. 2B, the gap 105 between the inner and outer shells 110, 120 is filled with the concrete mass 115 (the concrete mass 115 is removed from FIG. 2A so that the details of the inlet ducts 150 are visible). The concrete mass 115 of the overpack body 100 is enclosed by the inner and outer shells 110, 120, the baseplate 130, and the top shear ring 140. Until the lid 500 is placed onto the top of the overpack body 100, the concrete mass 115 is exposed at the gap 141. A set of steel radial connector plates 114 are connected to and join the inner and outer shells 110, 120 together, thereby defining a fixed width annular space (i.e., the gap 105) between the inner and outer shells 120, 110 in which the concrete mass 115 is poured as best seen in FIGS. 2A, 2B and 9. In the exemplified embodiment the radial connector plates 114 are flat plate-type members oriented in the radial direction but they can be curved or non-radial in other embodiments.

The material make-up of the concrete mass 115 between the inner and outer shells 120, 110 is specified to provide the necessary shielding properties (dry density) and compressive strength for the ventilated apparatus 1000. The principal function of the concrete mass 115 is to provide shielding against gamma and neutron radiation. However, the concrete mass 115 also helps enhance the performance of the ventilated apparatus 1000 in other respects as well. For example, the massive bulk of the concrete mass 115 imparts a large thermal inertia to the ventilated apparatus 1000, allowing it to moderate the rise in temperature of the ventilated apparatus 1000 under hypothetical conditions when all ventilation passages 150, 550 are assumed to be blocked. The case of a postulated fire accident at an ISFSI is another example where the high thermal inertia characteristics of the concrete mass 115 of the ventilated apparatus 1000 control the temperature of the MPC 200. Although the annular concrete mass 115 in the overpack body 100 is not a structural member, it does act as an elastic/plastic filler of the inter-shell space.

While the overpack body 100 has a generally circular horizontal cross-section in the exemplified embodiment, the invention is not so limited. As used herein, the term "cylindrical" includes any type of prismatic tubular structure that forms a cavity therein. As such, the overpack body 100 can have a rectangular, circular, triangular, irregular or other polygonal horizontal cross-section. Additionally, the term "concentric" includes arrangements that are non-coaxial and the term "annular" includes varying width.

As noted above, the overpack body 100 comprises a plurality of specially designed inlet ducts 150. The inlet ducts 150 are located at a bottom of the overpack body 100 and allow cool air to enter the cavity 10 of the ventilated apparatus 1000. The inlet ducts 150 form passageways that pass from the exterior atmosphere into the cavity 10 through the concrete mass 115 in the gap 105. Specifically, the inlet ducts 150 extend from an opening 123 in the outer shell 120 to an opening 113 in the inner shell 110. Each of the inlet ducts 150 is formed by the openings 113, 123 in the inner and outer shells 110, 120 and a lower metal inter-shell connector 155 (or a pair of lower metal inter-shell connectors 155 as described below) extending between one of the openings 113 in the inner shell 110 and one of the openings 123 in the outer shell 120.

The inlet ducts 150 are positioned about the circumference of the overpack body 100 in a radially symmetric and spaced-apart arrangement. Thus, air from the external atmosphere can pass through the opening 123 in the outer shell 120 and into the inlet ducts 150 and then through the openings 113 in the inner shell 110 and into the internal cavity 10 of the overpack body 100. Once within the cavity 10, the air is warmed by the heat emanating from the MPC 200 stored in the cavity 10. This causes the air to flow upwardly within the cavity 10 towards the lid 500 and pass from a top portion of the cavity 10 through the outlet duct(s) 550 to the external atmosphere. The structure, arrangement and function of the inlet ducts 150 will be described in much greater detail below with reference to FIG. 4.

In the exemplified embodiment, the MPC 200 rests directly on a top surface 131 of the base plate 130. In other embodiments, gussets may be included that connect the inner surface 111 of the inner shell 110 to the top surface 131 of the base plate 130, and the gussets may support the MPC 200. Such gussets may additionally act as guides for properly aligning the MPC 200 within the cavity 10 during loading and as spacers for maintaining the MPC 200 in the desired alignment within the cavity 10 during storage.

Figure 3A:
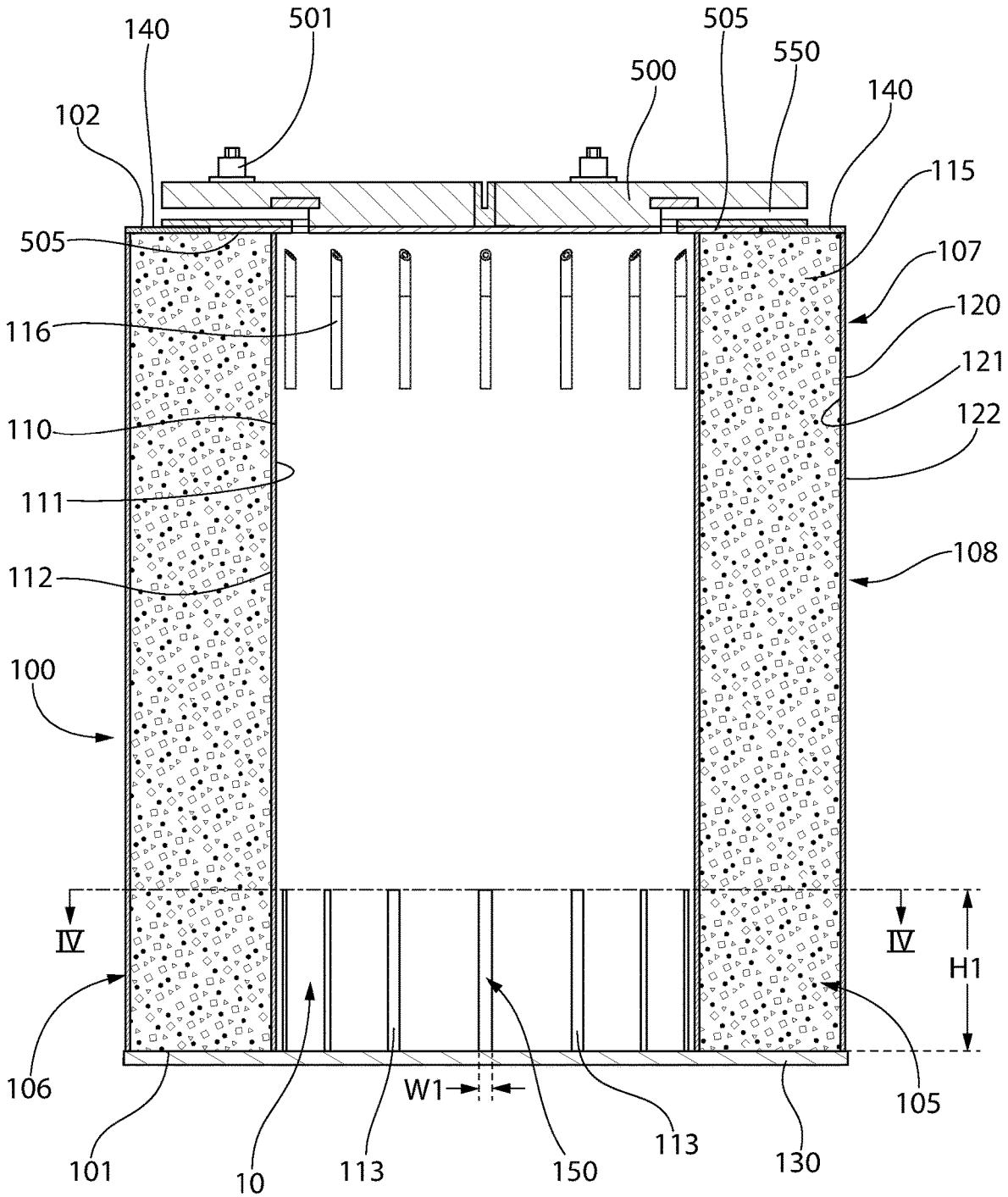
FIG. 3A is a cross-sectional view taken along line IIIA-IIIA of FIG. 1 without the canister in the cavity of the overpack body.
Figure 3B:
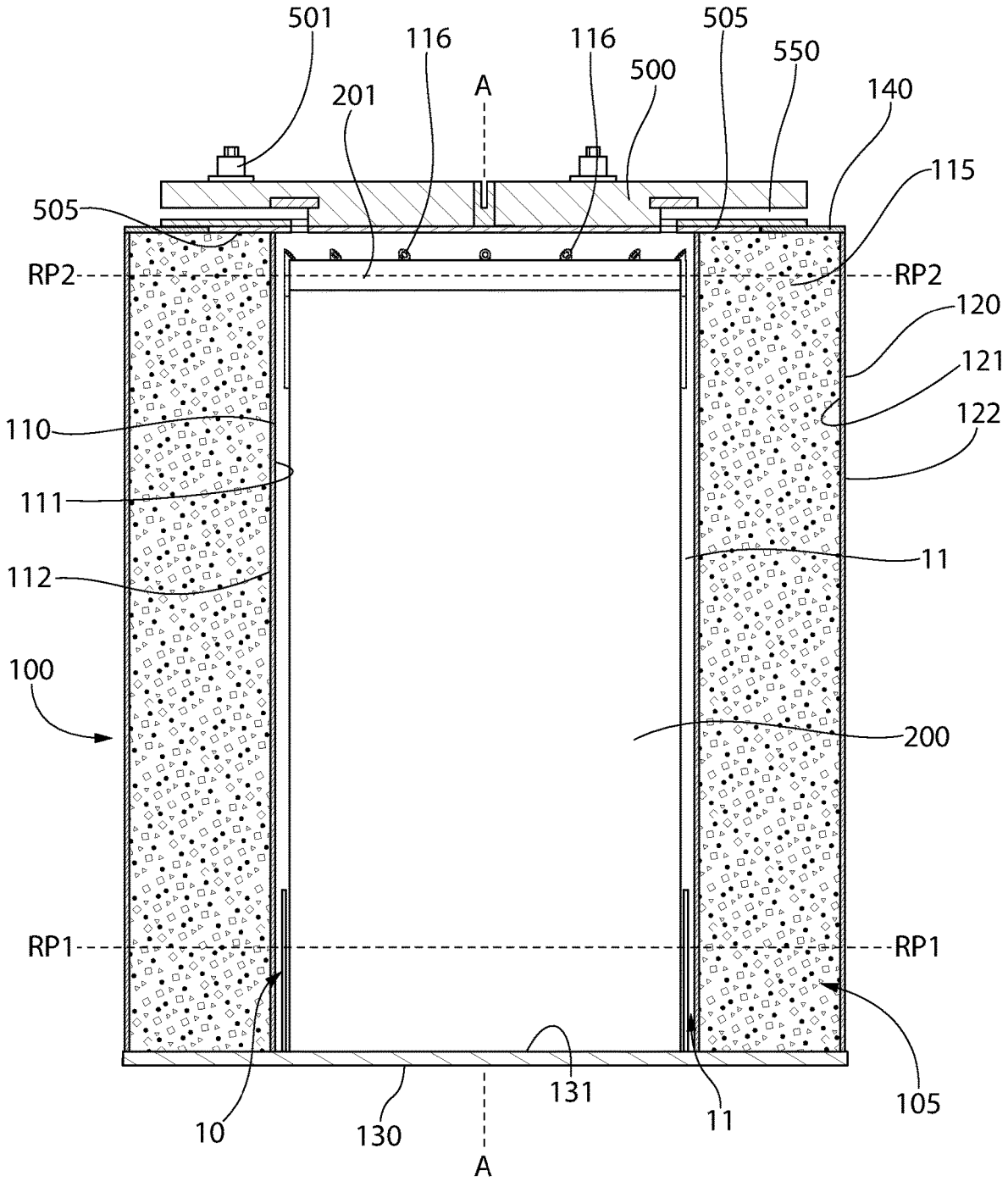
FIG. 3B is a cross-sectional view taken along line IIIA-IIIA of FIG. 1 with the canister positioned in the cavity of the overpack body.

When the MPC 200 is positioned in the cavity 10, an annular gap 11 exists between the outer surface of the MPC 200 and the inner surface 111 of the overpack body 100 (best seen in FIG. 3B). This provides a space for the air to flow around the MPC 200 as the cool air enters the cavity 10 through the air inlet ducts 150, becomes heated within the cavity 10, and then exits the cavity 10 through the air outlet ducts 550.

The overpack body 100 also comprises a set of tubular shock absorbers 116 coupled to the inner surface 111 of the overpack body 100 (i.e., the inner surface 111 of the inner shell 110). The tubular shock absorbers 116 are only illustrated being located near the top of the cavity 10 but can additionally be located near the bottom of the cavity. The tubular shock absorbers 116 are arranged in a circumferentially spaced apart manner about the inner surface 111 of the overpack body 100. In the exemplified embodiment, the tubular shock absorbers 116 are hollow tube like structures but can be plate structures if desired. The tubular shock absorbers 116 serve as the designated locations of impact with the MPC lid 201 in case the ventilated apparatus 1000 tips over. The tubular shock absorbers 116 are designed to absorb kinetic energy to protect the MPC 200 during an impactive collision (such as a non-mechanistic tip-over scenario). Thus, in the exemplified embodiment, the tubular shock absorbers 116 are thin steel members sized to serve as impact attenuators by crushing (or buckling) against the solid MPC lid 201 during an impactive collision (such as a non-mechanistic tip-over scenario). The tubular shock absorbers 116 may be included to protect the fuel stored in the MPC 200 from experiencing large inertia loads in the unlikely event that the ventilated apparatus 1000 were to tip over. The tubular shock absorbers 116 are aligned with a hard location in the MPC 200, such as its closure lid 201 (see FIG. 3B), so that impact between the MPC 200 and the overpack body 100 is ameliorated by the tubular shock absorbers 116 during a tip over event.

The overpack body 100 generally has a bottom portion 106 which is the portion that includes the air inlet ducts 150, a top portion 107 which is generally the portion that includes the tubular shock absorbers 116, and a middle portion 108 therebetween. In certain embodiments the air inlet ducts 150 may be approximately three feet tall, and thus the bottom portion 106 of the overpack body 100 may be approximately the bottom three feet of the overpack body 100. The MPC 200 is illustrated in the cavity 10 in FIG. 3B with the MPC 200 resting directly atop the top surface 131 of the base plate 130. As best seen in this figure, the set of tubular shock absorbers 116 are positioned so that a reference plane RP2-RP2 that is perpendicular to the longitudinal axis A-A of the overpack body 100 intersects both a lid 201 of the MPC 200 and the set of tubular shock absorbers 116.

Figure 4:
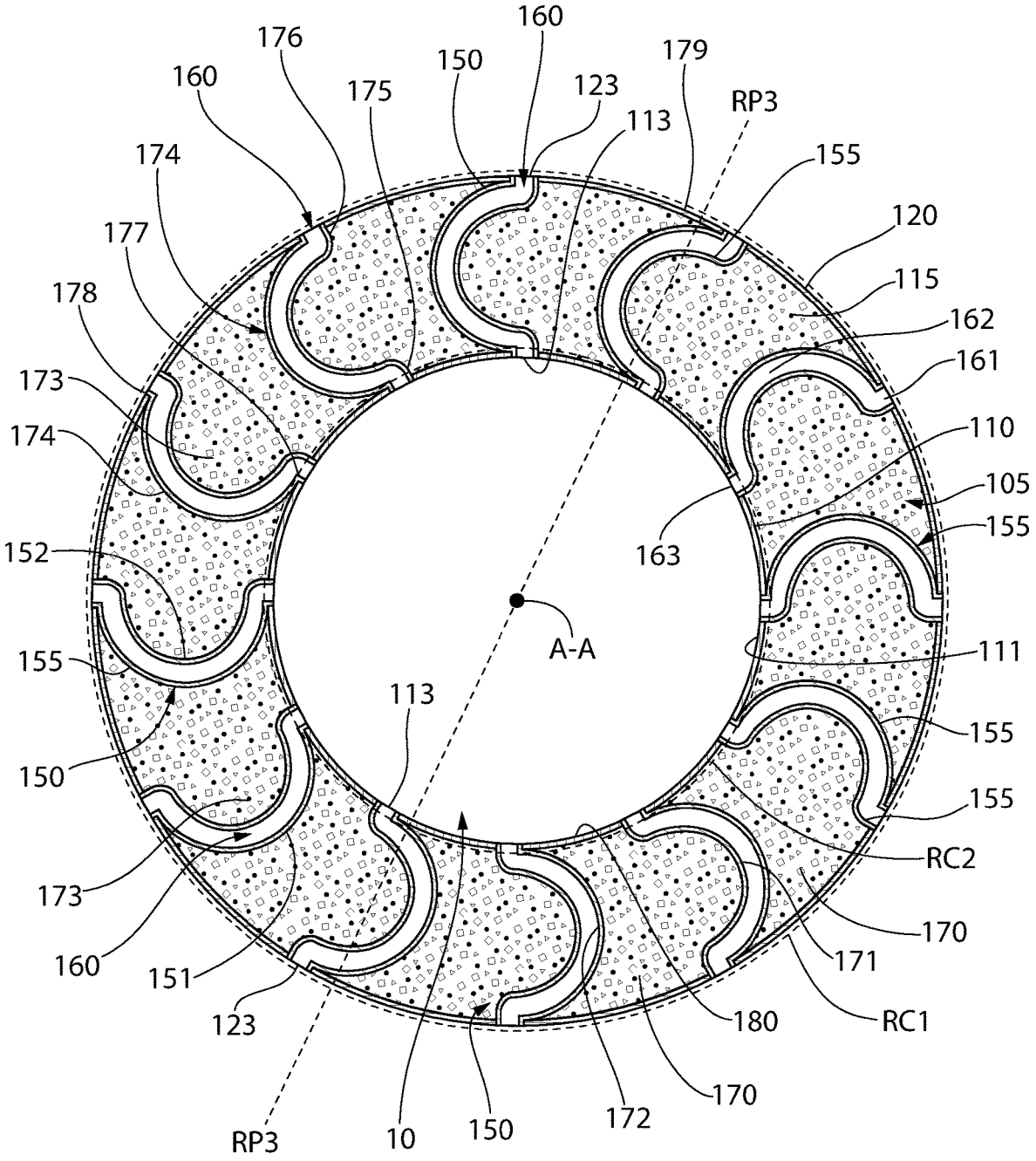
FIG. 4 is a cross-sectional view taken along line IV-IV of FIG. 3A.
Figure 5:
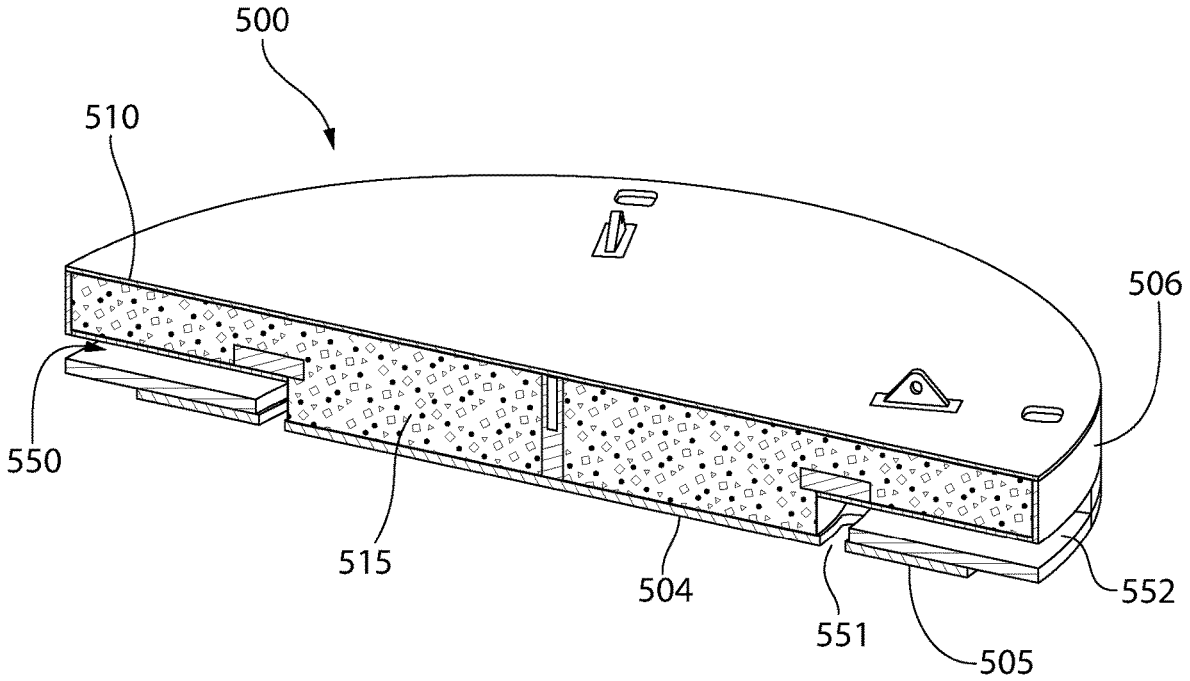
FIG. 5 is a cross sectional view of the lid of the overpack body in accordance with a first embodiment of the present invention.

Referring now to FIGS. 2A, 2B, and 4 the overpack body 100 and specifically the structure thereof that forms the air inlet ducts 150 will be described in greater detail. The bottom portion 106 of the overpack body 100 is formed by a plurality of spaced apart segments or curved segments 170. Each segment 170 is a circumferential section of the bottom portion 106 of the overpack body 100 and thus it is curved because the overpack body 100 is cylindrical in the exemplified embodiment. Each of the segments 170 is spaced apart from an adjacent segment 170 and the air inlet ducts 150 are formed in the spaces between the adjacent segments 170. Each of the segments 170 extends circumferentially from a first end wall 171 having a convex portion or a projection 173 to a second end wall 172 having a concave portion or a channel 174. For each of the segments 170 that form the bottom portion 106 of the overpack body 100, the projection 173 and the channel 174 extend along the entire height of that segment 170. The segments 170 are also referred to herein as curved segments because they form the bottom portions of the curved inner and outer surfaces 111, 122 of the overpack body 100.

The first end wall 171 of each of the segments 170 comprises a first shoulder 175 on a first side of the projection 173 and a second shoulder 176 on a second side of the projection 173. Specifically, the first shoulder 175 of each segment 170 is adjacent to (and may include a portion of) the inner shell 110 and the second shoulder 176 of each segment 170 is adjacent to (and may include a portion of) the outer shell 120. In the exemplified embodiment the first shoulder 175 of each segment 170 is formed partially by the concrete mass 115 and partially by the inner shell 110 whereas the second shoulder 176 of each segment 170 is formed partially by the concrete mass 115 and partially by the outer shell 120. In other embodiments, the first and second shoulders 175, 176 may be formed wholly by the inner and outer shells 110, 120, respectively, and the projection 173 may be formed by the concrete mass 115. The first and second shoulders 175, 176 extend generally radially. Furthermore, the first and second shoulders 175, 176 of each respective segment 170 are aligned on the same plane.

The projection 173 is located between the first and second shoulders 175, 176 and protrudes circumferentially from the first and second shoulders 175, 176. The projection 173 of each segment 170 protrudes in the same circumferential direction. Specifically, in the exemplified embodiment each of the projections 173 protrudes from its respective segment 170 in a counter-clockwise direction. However, the invention is not to be so limited in all embodiments and in certain other embodiments each of the projections 173 may protrude from its respective segment 170 in a clockwise direction. However, in all embodiments the projections 173 should protrude in the same circumferential direction.

The second end wall 172 of each of the segments 170 comprises a first channel wall 177 adjacent to the inner shell 110 and a second channel wall 178 adjacent to the outer shell 120. In the exemplified embodiment, the first channel wall 177 of each segment 170 is formed entirely by the inner shell 110 but may also be formed by a portion of the concrete mass 115. Furthermore, in the exemplified embodiment the second channel wall 178 of each segment 170 is formed entirely by the outer shell 120 but may also be formed by a portion of the concrete mass 115. Furthermore, the first and second channel walls 177, 178 of each respective segment 170 are aligned on the same plane. The channel 174 is defined between the first and second channel walls 177, 178.

The segments 170 circumferentially surround the longitudinal axis A-A and are arranged in a nesting or intermeshing configuration. Specifically, the projection 173 of each segment 170 at least partially nests within the channel 174 of an adjacent segment 170 such that a plane that includes the longitudinal axis A-A will intersect the first end wall 171 (projection 173) of a first one of the segments 170 and a second end wall 172 (channel 174) of a second one of the segments 170 that is in a nested arrangement with the first one of the segments 170. Thus, the convex portion or the projection 173 of the first end wall 171 of a first one of the segments 170 at least partially nests within the concave portion or channel 174 of the second end wall 172 of an adjacent one of the segments 170 that is circumferentially adjacent to the first one of the segments 170. This is true for each of the adjacent segments 170. Thus, for each segment 170, an adjacent segment's projection 173 on a first side of the segment 170 nests within its channel 174 and the segment's projection 173 nests within an adjacent segment's channel 174 on the other side of the segment 170. In the exemplified embodiment, the channels 174 have a greater radius of curvature than the projections 173. For two of the segments 170 to be nested, a plane that includes the longitudinal axis A-A needs to exist that intersects the first end wall 171 of one of the nested segments 170 and the second end wall 172 of the other one of the nested segments 170.

In the exemplified embodiment, a reference plane RP3 is illustrated (FIG. 4) that includes the longitudinal axis A-A and that intersects the first end wall 171 of a first one of the segments 170 and the second end wall 172 of an adjacent one of the segments 170. In fact, due to the spacing of the segments 170 in the exemplified embodiment, the reference plane RP3 will also intersect the first end wall 171 of one segment 170 and the second end wall 172 of an adjacent segment 170 that are circumferentially spaced 180° from the first one of the segments 170 and its adjacent segment 170.

Furthermore, despite the nesting/intermeshing arrangement described above and shown in FIG. 4, the convex portion or projection 173 of the first end wall 171 of the first one of the segments 170 is spaced apart from the concave portion or channel 174 of the second end wall 172 of the adjacent one of the segments 170. Thus, the projection 173 of the first end wall 171 of the first one of the segments 170 nests within the channel 174 of the second end wall 172 of the adjacent one of the segments 170 without the first end wall 171 of the first one of the segments 170 contacting the second end wall 172 of the adjacent one of the segments 170. The spaces between the segments 170 form the air inlet ducts 150, which form air inlet passageways 160 from the external atmosphere to a bottom portion of the cavity 10 as discussed herein.

More specifically, the lower inter-shell connectors 155 are disposed within the spaces between the adjacent segments 170. During manufacturing, the lower inter-shell connectors 155 are put into position first and then the concrete mass 115 is poured around the lower inter-shell connectors 155, although other manufacturing techniques are possible. The inter-shell connectors 155 are provided in pairs and covered with a roof 156 such that each pair of inter-shell connectors 155 defines one of the air inlet ducts 150 therebetween although each air inlet duct 150 could be formed by a singular member in other embodiments. Each of the inter-shell connectors 155 extends from the opening 123 in the outer shell 120 to the opening 113 in the inner shell 110 to form a passageway therebetween. Furthermore, one of the inter-shell connectors 155 is in contact with each of the first and second end walls 171, 172 of each of the segments 170. Thus, the inter-shell connectors 155 take on the shape of the first and second end walls 171, 172 of the segments 170. Each of the air inlet ducts 150 is formed between one of the inter-shell connectors 155 in contact with the first end wall 171 of a first segment 170 and one of the inter-shell connectors 155 in contact with the second end wall 172 of a second segment 170 that is adjacent to the first segment 170.

In the exemplified embodiment the channels 174 of each of the segments 170 have an identical radius of curvature and the projections 173 of each of the segments 170 have an identical radius of curvature. Thus, in the exemplified embodiment each segment 170 is identical in size and shape to each other segment 170. Of course, this is not required in all embodiments and in alternative embodiments the segments 170 can be different sizes and shapes. Furthermore, in the exemplified embodiment each pair of adjacent segments 170 is spaced apart the same distance, thereby forming a plurality of the air inlet ducts 150 having the same dimensions. However, the invention is not to be so limited and the spacing between the segments 170 and hence also the dimensions/widths of the air inlet ducts 150 may vary in alternative embodiments.

As can be seen in FIG. 4, each of the segments 170 is a singular uninterrupted member. Thus, there is no space or gap within any one of the individual segments 170. The only air passageways from the external atmosphere to the cavity 10 are between adjacent segments 170 and there are no air passageways formed within an individual segment 170. Rather, each of the segments 170 is an uninterrupted portion of the overpack body 100 that is formed of a solid material. Thus, a single segment 170 has a convex end wall (i.e., the first end wall 171) and a concave end wall (i.e., the second end wall 172) without any gaps or spaces being formed in the segment 170 between the first and second end walls 171, 172 in the circumferential direction. The only gaps are the air inlet ducts 150 which are formed between adjacent ones of the segments 170 and not within the segments 170.

In the exemplified embodiment, there are twelve of the air inlet ducts 150 illustrated. However, due to the shape of the air inlet ducts 150 described in more detail below, it would be possible to include many more of the air inlet ducts 150 in other embodiments. Specifically, the air inlet ducts 150 can be positioned very close to one another and can possibly even be placed in a nesting or partially nesting arrangement. This would increase the number of openings in the outer shell 120 and the number of pathways available for the external air to enter into the cavity 10 to more effectively cool the MPC 200 stored therein and make the air inlet less sensitive to the direction of ambient wind.

Each of the segments 170 also has a convex outer wall 179 and a concave inner wall 180. The convex outer wall 179 of each segment 170 forms a portion of the outer surface 122 of the overpack body 100. The concave inner wall 180 of each segment 170 forms a portion of the inner surface 111 of the overpack body 110. The convex outer walls 179 of the segments 170 lie in a first reference cylinder RC1. The concave inner walls 180 of the segments 170 lie in a second reference cylinder RC2 that is concentric to the first reference cylinder RC1.

In the exemplified embodiment, each of the air inlet ducts 150 is a generally U-shaped structure defining generally U-shaped air inlet passageways 160 extending from the opening 123 in the outer shell 120 to the opening 113 in the inner shell 110. Thus, each of the air inlet ducts 150 (and also each of the air inlet passageways 160) has a convex side 151 and a concave side 152. The convex side 151 of each of the air inlet ducts 150 (and each of the air inlet passageways 160) faces the concave side 152 of an adjacent one of the air inlet ducts 150 (or air inlet passageways 160). Similarly, the concave side 152 of each of the air inlet ducts 150 (and each of the air inlet passageways 160) faces the convex side 151 of an adjacent one of the air inlet ducts 150 (or air inlet passageways 160). Thus, the air inlet ducts 150 may be positioned closer together than that illustrated in a nesting arrangement as mentioned above to increase the number of air inlet ducts 150 included in the apparatus 1000 in some embodiments.

Furthermore, each of the air inlet passageways 160 comprises a first radial section 161 extending from the outer surface 122 of the overpack body 100 towards the cavity 10, a curved section 162 extending from the first radial section 161 towards the cavity 10, and a second radial section 163 extending from the curved section to the inner surface 111 of the overpack body 100. The first and second radial sections 161, 163 of each air inlet passageway 160 are aligned on the same radius of the first reference cylinder RC1 or on the same reference plane that includes the longitudinal axis A-A. In the exemplified embodiment, the overall shape of the air inlet passageways 160 are that of a horseshoe having ends that extend outwardly away from a longitudinal centerline of the horseshoe.

Due to the U-shape of the air inlet passageways 160 of the air inlet ducts 150, a line of sight does not exist from the cavity 10 to the external atmosphere through the air inlet passageway 160 of the air inlet ducts 150. Specifically, viewing through the air inlet passageways 160 of the air inlet ducts 150 from the cavity 10, a person will not be able to see through to the external atmosphere, and vice versa. Although the U-shape is illustrated in the exemplified embodiment, other shapes are possible so long as a line of sight does not exist through the air inlet passageway 160 as noted herein. In some embodiments, the MPC 200 is positioned within the cavity 10 so that a first reference plane RP1 that is perpendicular to the longitudinal axis A-A of the overpack body 100 intersects both the MPC 200 and the inlet ducts 150. However, even though the MPC 200 is positioned atop the top surface 131 of the base plate 130 and thus is transversely aligned with the air inlet ducts 150, radiation (which travels in a straight line and cannot follow a tortuous path) cannot pass from the MPC 200 to the external environment. Rather, all radiation will contact the concrete mass 115 thereby preventing the radiation (both gamma and neutron radiation) from passing to the external environment.

To maximize the cooling effect that the ventilating air stream has on the MPC 200 within the ventilated apparatus 1000, the hydraulic resistance in the air flow path is minimized to the extent possible. Towards that end, the ventilated apparatus 1000 comprises twelve inlet ducts 150 (shown in FIG. 4) in the exemplified embodiment. Of course, more or less inlet ducts 150 can be used as desired. Each inlet duct 150 is narrow and tall so as to minimize radiation streaming while optimizing the size of the airflow passages. The curved shape of the inlet ducts 150 also helps minimize hydraulic pressure loss. In one embodiment, each of the inlet ducts 150 has a height H1 and a width W1 (denoted in FIG. 3A) such that a ratio of the height to the width is at least 10:1, and more specifically at least 15:1, and still more specifically approximately 18:1. In one embodiment, the height is approximately 36 inches and the width is approximately 2 inches.

The inlet ducts 150 permit the MPC 200 to be positioned directly atop the top surface 131 of the base plate 130 of the ventilated apparatus 1000 if desired, thus minimizing the overall height of the cavity 10 that is necessary to house the MPC 200. Naturally, the height of the overpack body 100 may then also be minimized. Minimizing the height of the overpack body 100 is an important ALARA-friendly design feature for those sites where the Egress Bays in their Fuel Buildings have low overhead openings in their roll-up doors. To this extent, the height of the storage cavity 10 in the ventilated apparatus 1000 is set equal to the height of the MPC 200 plus a fixed amount to account for thermal growth effects and to provide for adequate ventilation space above the MPC 200.

As described herein, the MPC 200 can be placed directly on the base plate 130 such that the bottom region of the MPC 200 is level with the inlet ducts 150 because radiation emanating from the MPC 200 is not allowed to escape through the specially shaped inlet ducts 150 due to: (1) the inlet ducts 150 having a narrow width and being curved in shape; (2) the configuration of the inlet ducts 150 is such that that there is no clear line of sight from inside the cavity 10 to the exterior environment; and (3) there is enough steel and/or concrete in the path of any radiation emanating from the MPC 200 to de-energize it to acceptable levels. With the radiation streaming problem at the inlet ducts 150 solved, the top 102 of the overpack body 100 can be as little as ½" higher than a top surface of the MPC 200.

Additionally, positioning the MPC 200 in the cavity 10 so that the bottom surface of the MPC 200 is below the top of the opening 152 of the inlet ducts 150 ensures adequate MPC cooling during a "smart flood condition." A "smart flood" is one that floods the cavity 10 so that the water level is just high enough to completely block airflow though the inlet ducts 150. In other words, the water level is just even with the top of the inlet ducts 150. Because the bottom surface of the MPC 200 is situated at a height that is below the top of the openings 123 of the inlet ducts 150, the bottom of the MPC 200 will be in contact with (i.e. submerged in) the water during a "smart flood" condition. Because the heat removal efficacy of water is over 100 times that of air, a wet bottom is all that is needed to effectively remove heat and keep the MPC 200 cool. Due to the height of the inlet ducts 150 being approximately 36 inches, the amount of water required to block the entire inlet duct 150 is a sufficient amount of water to cool the MPC 200. Thus, during a "smart flood condition" as described herein, the MPC cooling action effectively changes from ventilation air-cooling to evaporative water cooling.

As noted above, the lid 500 is provided to close the open top end of the cavity 10. The lid 500 may also be provided with a structure that forms outlet ducts 550, thereby permitting air that is heated within the cavity 10 to exit the cavity 10 at a top portion of the cavity 10. The outlet ducts 550 may be formed into the lid 500 itself, or may be formed at the interface of the lid 500 and the overpack body 100. Either way, as heated air leaves the cavity 10 through the outlet ducts 550, cool air will continue to enter the cavity 10 at a bottom portion thereof through the air inlet ducts 150. This creates a natural convective flow of air to cool the MPC 200 within the cavity 10.

Referring to FIGS. 1-3B and 5, the overpack lid 500 will be described in accordance with one embodiment of the present invention. The overpack lid 500 is a weldment of steel plates 510 filled with a concrete mass 515 that provides neutron and gamma attenuation to minimize skyshine. The lid 500 is secured to the top end 102 of the overpack body 100 by a plurality of bolts 501 that extend through the lid 500. The lid 500 may in other embodiments include a lid flange and the bolts 501 may extend through the lid flange for securing to the overpack body 100. In the exemplified embodiment, the bolts 501 connect to bolt receiving apertures 117 formed into the radial connector plates 114 as best shown in FIG. 9. Of course, alternative structures for securing the lid 500 to the overpack body 100 are possible in other embodiments. When secured to the overpack body 100, surface contact between the lid 500 and the overpack body 100 forms a lid-to-body interface. The lid 500 is preferably non-fixedly secured to the body 100 and encloses the top end of the cavity 10 formed by the overpack body 100.

In the embodiment of FIGS. 1-3B and 5, the lid 500 comprises a radial ring plate or shear ring 505 welded to a bottom surface of the lid 500 which provides additional shielding against the laterally directed photons emanating from the MPC 200 and/or the annular space 11 formed between the outer surface of the MPC 200 and the inner surface 121 of the inner shell 120. The shear ring 505 also assists in locating the top lid 500 in a coaxial disposition along the longitudinal axis A-A of the ventilated apparatus 1000 through its interaction with the shear ring 140 of the overpack body 100. When the lid 500 is secured to the overpack body 100, the outer edge of the shear ring 505 of the lid 500 abuts the inner edge of the shear ring 140 of the overpack body 100. Specifically, the shear ring 505 of the lid 500 lies within the gap 141 atop the concrete mass 115 between the shear ring 140 of the overpack body 100 and the inner shell 110. Thus, the shear ring 505 also functions to prevent the lid 500 from sliding across the top surface of the overpack body 100 during a postulated tip-over event defined as a non-mechanistic event for the ventilated apparatus 1000. Specifically, the contact between the shear ring 505 of the lid 500 and the shear ring 140 of the overpack body 100 prevents any such sliding movement of the lid 500 relative to the overpack body 100.

In this embodiment, the lid 500 comprises the plurality of outlet ducts 550 that allow heated air within the storage cavity 10 of the ventilated apparatus 1000 to escape. The outlet ducts 550 form passageways through the lid 500 that extend from openings 551 in the bottom surface 504 of the lid 500 to openings 552 in the peripheral surface 506 of the lid 500. While the outlet ducts 550 form L-shaped passageways in the exemplified embodiment, any other tortuous or curved path can be used so long as a clear line of sight does not exist from the external atmosphere to the ventilated apparatus 1000 into the cavity 10 through the outlet ducts 550. In the exemplified embodiment, the outlet ducts 550 are positioned about the circumference of the lid 500 in a radially symmetric and spaced-apart arrangement. The outlet ducts 550 terminate in openings 552 that are narrow in height but axi-symmetric in the circumferential extent. The narrow vertical dimensions of the outlet ducts 550 helps to efficiently block the leakage of radiation. It should be noted, however, that while the outlet ducts 550 are preferably located within the lid 500 in the exemplified embodiment, the outlet ducts 550 can be located within the overpack body 100 in alternative embodiments, for example at a top thereof, or at an interface of the lid 500 and the overpack body 100 as described herein with reference to FIGS. 8A-8C.

As has been mentioned herein, the purpose of the inlet ducts 150 and the outlet ducts 550 is to facilitate the passive cooling of an MPC 200 located within the cavity 10 of the ventilated apparatus 1000 through natural convection/ventilation. The ventilated apparatus 1000 is free of forced cooling equipment, such as blowers and closed-loop cooling systems. Instead, the ventilated apparatus 1000 utilizes the natural phenomena of rising warmed air, i.e., the chimney effect, to effectuate the necessary circulation of air about the MPC 200 stored in the storage cavity 10. More specifically, the upward flowing air (which is heated from the MPC 200) within the annular space 11 that is formed between the inner surface 121 of the overpack body 100 and the outer surface of the MPC 200 draws cool ambient air into the storage cavity 10 through inlet ducts 150 by creating a siphoning effect at the inlet ducts 150. The rising warm air exits the cavity 10 through the outlet ducts 550 as heated air. The rate of air flow through the ventilated apparatus 1000 is governed by the quantity of heat produced in the MPC 200, the greater the heat generation rate, the greater the air upflow rate.

Figure 6:
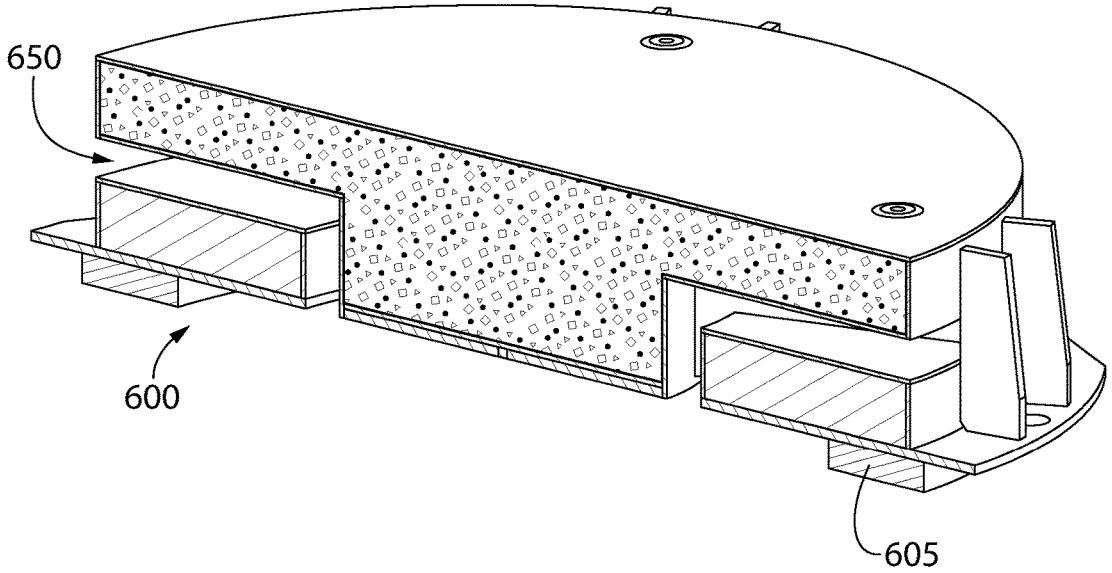
FIG. 6 is a cross-sectional view of the lid of the overpack body in accordance with a second embodiment of the present invention.

FIG. 6 illustrates another embodiment of a lid 600 that can be used with the overpack body 100. The lid 600 is very similar to the lid 500 described herein. In that regard, the lid 600 has a shear ring 505 and the lid 600 defines a plurality of outlet ducts 650. The differences in structure of the lid 600 relative to the lid 500 can be readily seen by viewing FIGS. 5 and 6 concurrently.

Figure 7:
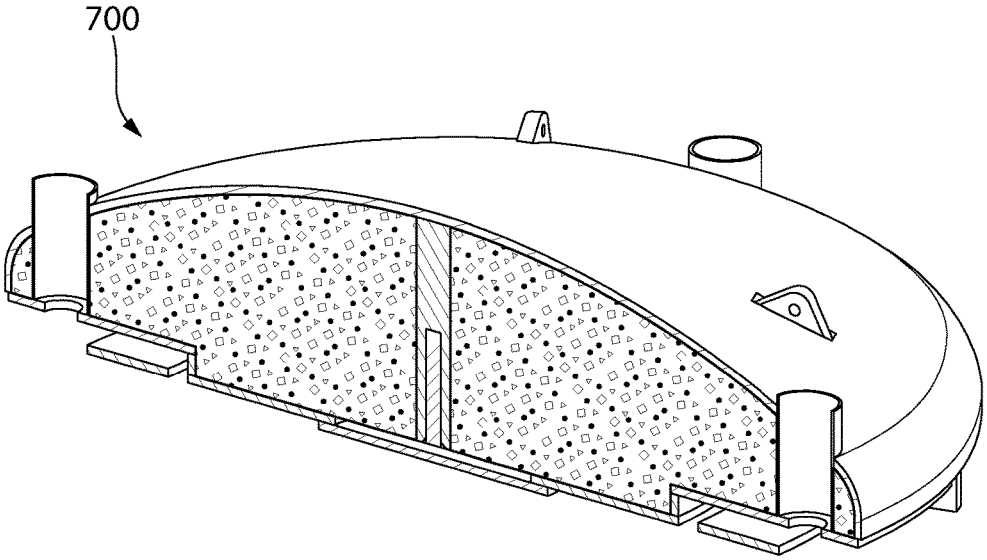
FIG. 7 is a cross-sectional view of the lid of the overpack body in accordance with a third embodiment of the present invention.

FIG. 7 illustrates yet another embodiment of a lid 700 that can be used with the overpack body 100. The lid 700 is similar to the lid 500 except as described herein. The first difference is that the lid 700 has a dome shape. A dome shaped lid such as the lid 700 may be used where the ventilated apparatus 1000 is required to withstand a very large downward load such as a falling missile. Further differences between the lid 700 and the lid 500 are also present in lid 800 illustrated in FIG. 8A and described below.

Figure 8A:
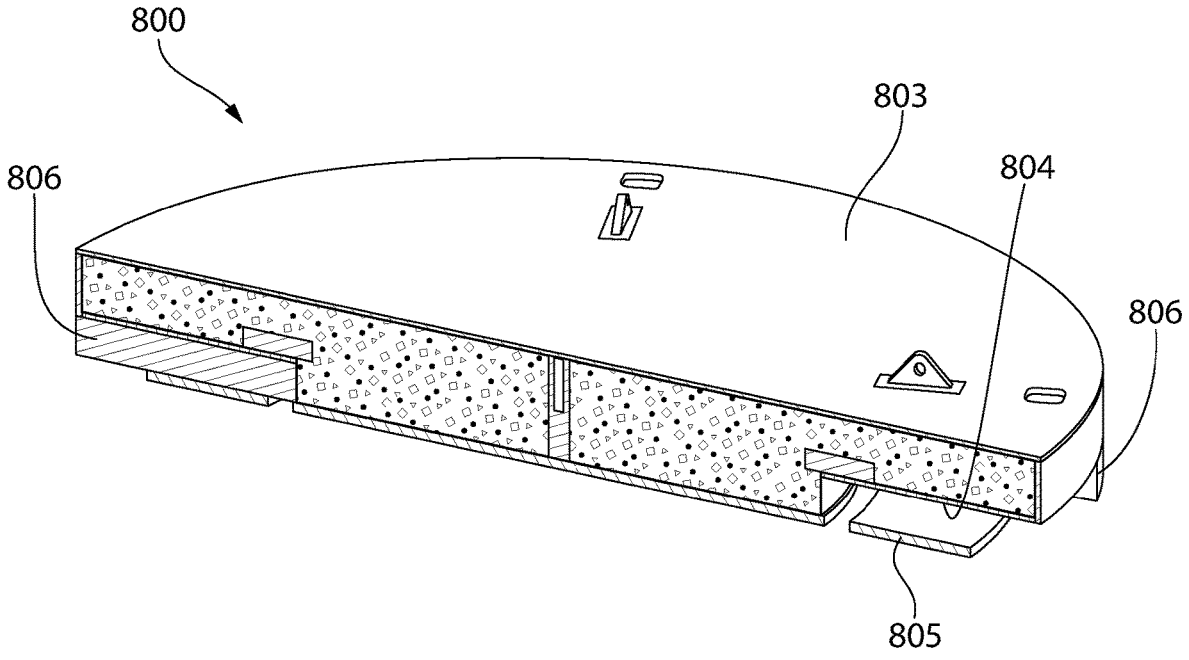
FIG. 8A is a cross-sectional view of the lid of the overpack body in accordance with a fourth embodiment of the present invention.
Figure 8B:
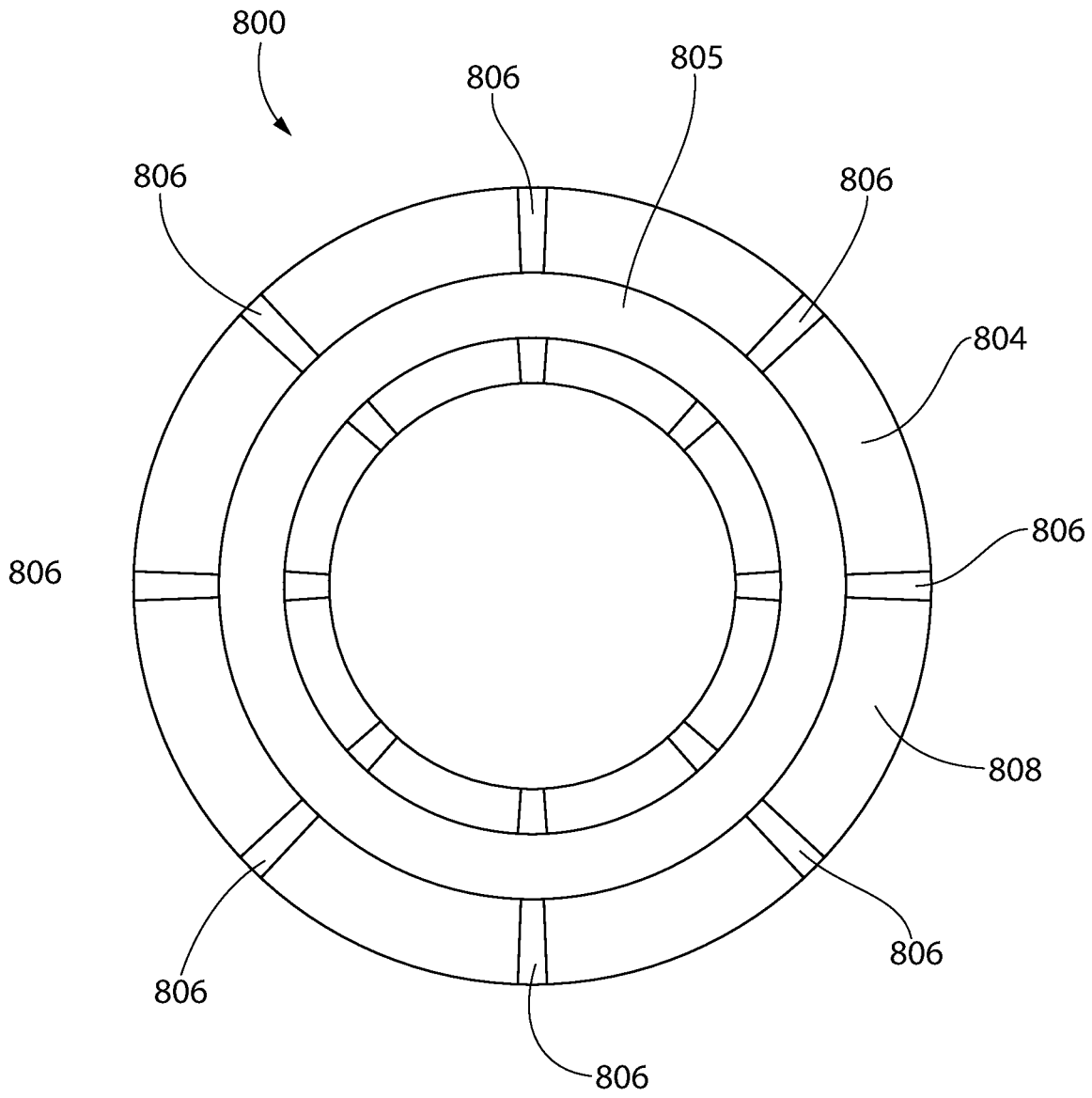
FIG. 8B is a simplified bottom view of the lid of FIG. 8A.
Figure 8C:
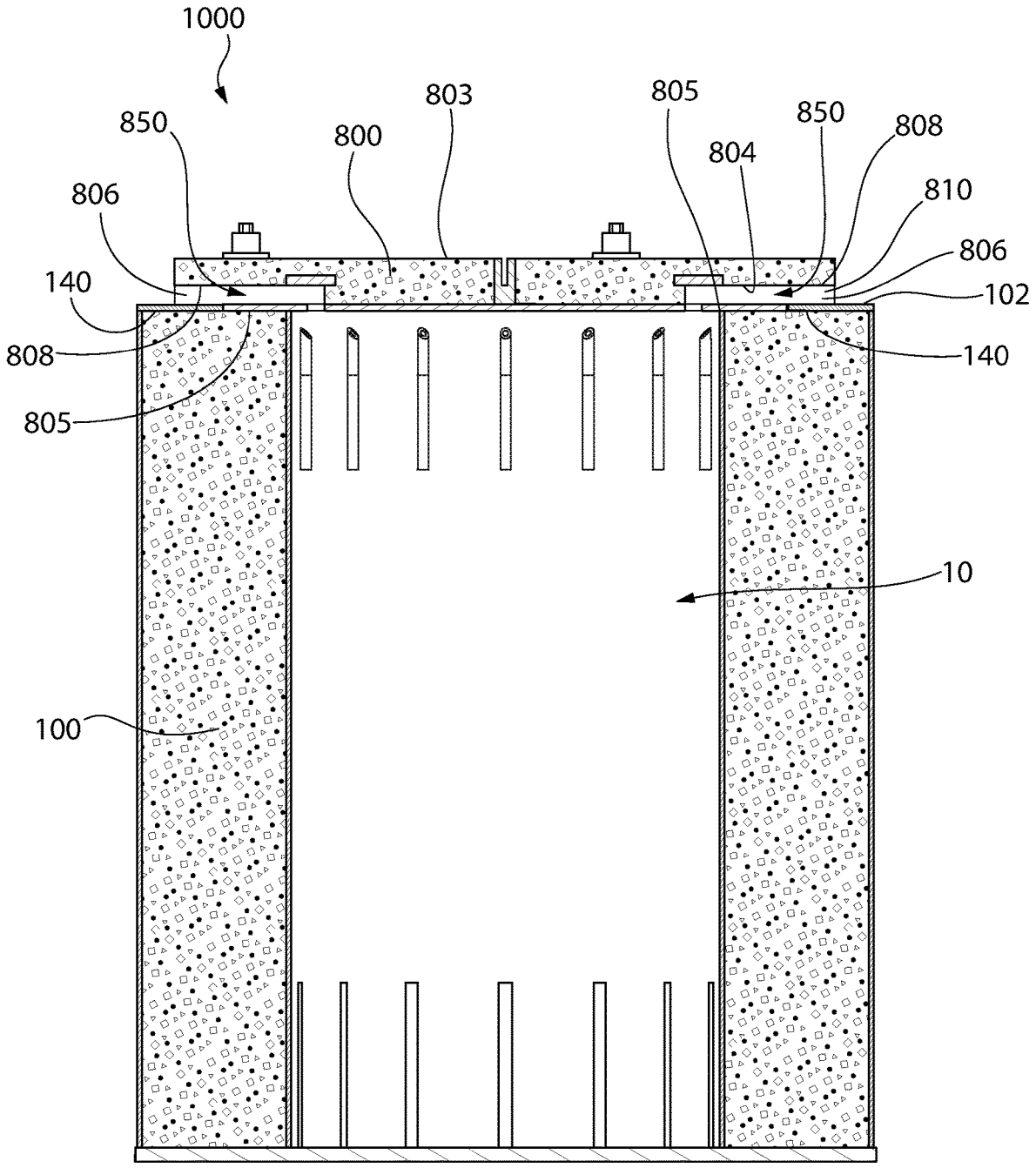
FIG. 8C is the cross-sectional view of FIG. 3A using the lid of FIG. 8A.

Referring to FIGS. 8A-8C, the lid 800 and its cooperative structure when coupled to the overpack body 100 will be described. The lid 800 is similar to the lid 500 except that the outlet passageways of the outlet ducts are at least partially defined by the interface between the lid 800 and the overpack body 100 rather than being formed directly into the lid. Thus, the lid 800 does not define the entirety of the outlet ducts but they are formed once the lid 800 is coupled to the overpack body 100 as shown in FIG. 8C.

Specifically, as seen in FIGS. 8A and 8B, the lid 800 comprises a bottom surface 804 and an opposite top surface 803. A plurality of spacers 806 are coupled to and extend from the bottom surface 804 of the lid 800. Furthermore, a shear ring 805 is coupled to the lid 800 via the spacers 806 such that the shear ring 805 is coupled directly to the terminal or distal ends of the spacers 806. Thus, the spacers 806 ensure that there is a space between the shear ring 805 and the bottom surface 804 of the lid 800.

Referring to FIG. 8C the lid 800 is shown coupled to the overpack body 100 described earlier. As shown, when the lid 800 is coupled to the overpack body 100, the shear ring 805 of the lid 800 abuts against the shear ring 140 of the overpack body 100 similar to that which was described with reference to FIGS. 1-4. Furthermore, the spacers 806 rest directly atop the shear ring 140 of the overpack body 100. Thus, the spacers 806 ensure that a space exists between the bottom surface 804 of the lid 800 and the shear ring 140 of the overpack body 100. This space forms a portion of the outlet ducts 850. As shown in FIG. 8C, although a portion of the outlet ducts 850 appear to be formed between the bottom surface 804 of the lid 800 and the shear ring 805 of the lid 800, a portion of the outlet ducts 850 is also formed between the bottom surface 804 of the lid 800 and the top surface 102 of the overpack body 100 (or the shear ring 140 of the overpack body 100). Specifically, in the exemplified embodiment each of the air outlet passageways comprises an outlet portion 810 that is formed by the top surface 102 of the overpack body 100 and a perimeter portion 808 of the bottom surface 804 of the lid 800. Thus, in this embodiment the outlet ducts 850 are at least partially defined by an interface between the lid 800 and the overpack body 100. Each of the air outlet ducts 850 forms an air outlet passageway from the top portion of the cavity 10 to the external atmosphere as with the previously described embodiments.

Figure 10:
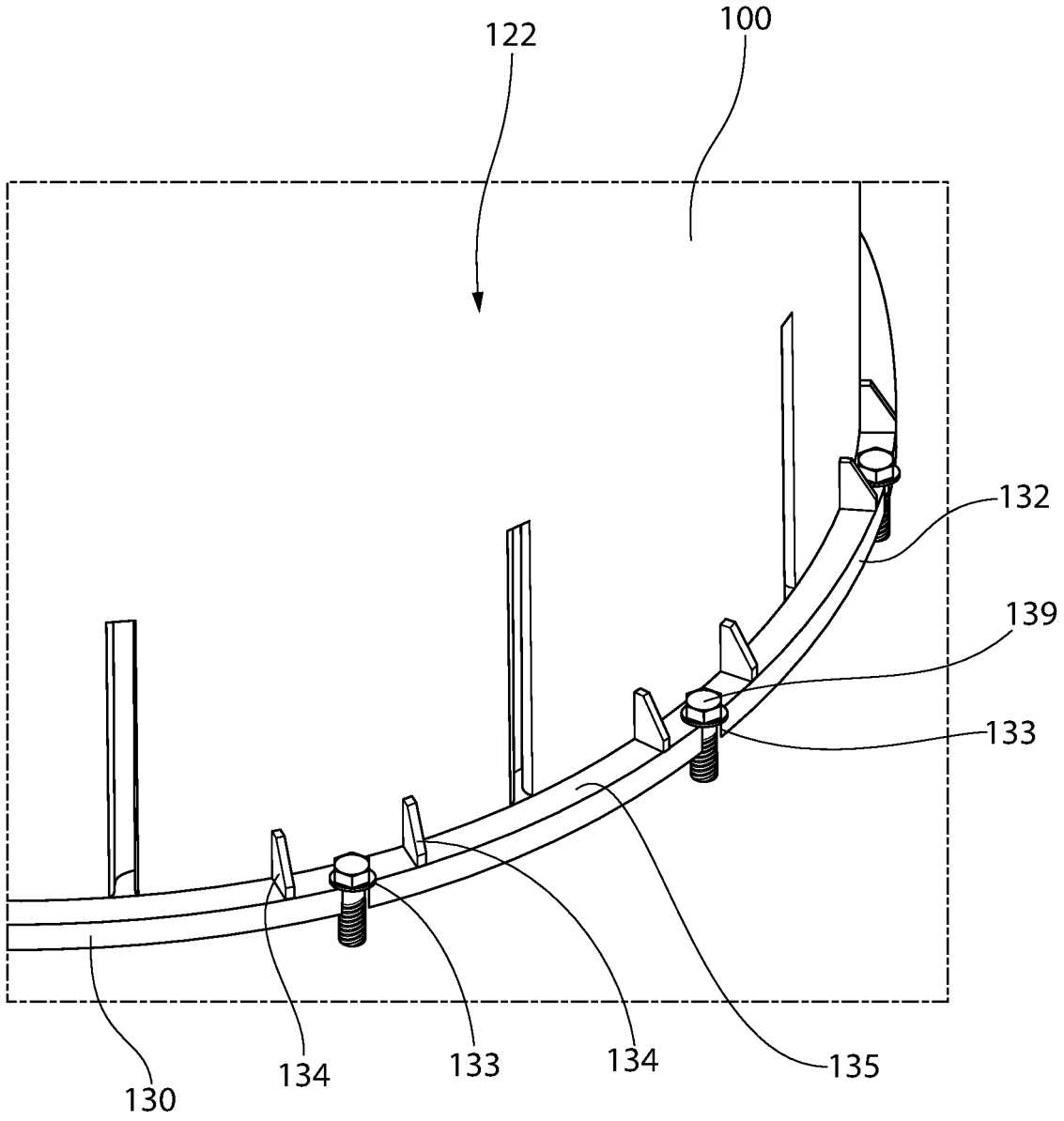
FIG. 10 is a close-up view illustrating an extended base of the overpack body in accordance with an embodiment of the present invention.

FIG. 10 is a close-up view of a portion of the bottom of the overpack body 100 in accordance with an alternative embodiment. In some embodiments, it may be desired to restrain the ventilated apparatus 1000 from movement on the storage pad at the ISFSI. Thus, in this embodiment the base plate 130 has been extended so as to form a flange 132 that protrudes from the outer surface 122 of the overpack body 100. The flange 132 has a plurality of apertures 133 therethrough, each of which operates as an anchor location through which an anchor 139 (screw, bolt, etc.) can be inserted to secure the overpack body 100 to a storage pad or other desired surface. The anchor locations are reinforced by gussets 134 that extend from the outer surface 122 of the overpack body 100 to the upper surface 135 of the flange 132. The radial dimension of the flange 132 (i.e., the distance that it extends from the outer surface 122 of the overpack body 100) is preferably minimized to minimize movement of the flange 132 during a cask uplift or tipping event and to facilitate its handling by a vertical cask transporter without significantly increasing the overall width dimension of the overpack body 100.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A ventilated apparatus for transporting and/or storing radioactive materials comprising:

an overpack body having an outer surface and an inner surface forming an internal cavity about a longitudinal axis;

a base enclosing a bottom end of the cavity;

a lid enclosing a top end of the cavity;

a plurality of outlet ducts, each of the outlet ducts forming an air outlet passageway from a top portion of the cavity to an external atmosphere;

a bottom portion of the overpack body formed by a plurality of curved segments, each of the curved segments extending circumferentially from a first end wall having a convex portion to a second end wall having a concave portion; and the curved segments circumferentially surrounding the longitudinal axis and arranged in an intermeshing configuration such that for all adjacent curved segments: (1) the convex portion of the first end wall of one of the curved segments at least partially nests within the concave portion of the second end wall of an adjacent one of the curved segments; and (2) the convex portion of the first end wall of the one of the curved segments is spaced from the concave portion of the second end wall of the adjacent one of the curved segments, thereby forming an inlet duct forming an air inlet passageway 160 from the external atmosphere to a bottom portion of the cavity.

2. The ventilated apparatus according to claim 1 wherein each of the curved segments has a convex outer wall that forms a portion of the outer surface of the overpack body and a concave inner wall that forms a portion of the inner surface of the overpack body; and wherein the convex outer walls of the curved segments lie in a first reference cylinder and the concave inner walls of the curved segments lie in a second reference cylinder.

3. The ventilated apparatus according to claim 1 wherein, for each of the air inlet passageways, a line of sight does not exist from the cavity to the external atmosphere through the air inlet passageway.

4. The ventilated apparatus according to claim 1 wherein each of the air inlet passageways comprises a first radial section extending from the outer surface of the overpack body, a curved section extending from the first radial section, and a second radial section extending from the curved section to the inner surface of the overpack body.

5. The ventilated apparatus according to claim 1 wherein each of the curved segments is a singular uninterrupted member.

6. The apparatus according to claim 1 wherein the overpack body comprises an inner metal shell and an outer metal shell concentrically arranged so that a gap exists between the inner and outer shells, a concrete material provided in the gap.

7. The apparatus according to claim 6 further comprising a plurality of lower metal inter-shell connectors extending between the inner and outer metal shells, the lower metal inter-shell connectors defining the inlet ducts.

8. The apparatus according to claim 1 wherein each of the inlet ducts has a height and a width, and wherein a ratio of height to width is at least 10:1.

9. The apparatus according to claim 1 wherein the air outlet passageways of the outlet ducts are at least partially defined by an interface between the lid and the overpack body.

10. The apparatus according to claim 1 further comprising a hermetically sealed canister for containing radioactive materials positioned within the cavity so that a first reference plane that is perpendicular to the longitudinal axis of the overpack body intersects both the canister and the inlet ducts.

11. The apparatus of claim 10 further comprising a set of tubular shock absorbers coupled to the inner surface of the overpack body, the set of tubular shock absorbers positioned so that a second reference plane that is perpendicular to the longitudinal axis of the overpack body intersects both a lid of the canister and the set of tubular shock absorbers.

12. A ventilated apparatus for transporting and/or storing radioactive materials comprising:

an overpack body having an outer surface and an inner surface forming an internal cavity about a longitudinal axis;

a base enclosing a bottom end of the cavity;

a lid enclosing a top end of the cavity;

a plurality of outlet ducts, each of the outlet ducts forming an air outlet passageway from a top portion of the cavity to an external atmosphere;

a bottom portion of the overpack body formed by a plurality of segments, each of the segments extending from a first end wall having a projection to a second end wall having a channel; and the segments circumferentially surrounding the longitudinal axis and arranged in an intermeshing and spaced-apart configuration such that the projections of the first end walls of the segments project into the channels of the second end walls of adjacent ones of the segments, thereby forming an inlet duct between adjacent ones of the segments that includes an air inlet passageway from the external atmosphere to a bottom portion of the cavity through which a line of sight does not exist from the cavity to the external atmosphere.

13. The ventilated apparatus according to claim 12 wherein, for each of the segments, the channel and the projection extend along the entire height of the segment.

14. The ventilated apparatus according to claim 12 wherein, for each of the segments, the first end wall further comprises a first shoulder on a first side of the projection and a second shoulder on a second side of the projection opposite the first side.

15. The ventilated apparatus according to claim 12 wherein, for each of the segments, the second end wall comprises a first channel wall and a second channel wall that define the channel therebetween.

16. The ventilated apparatus according to claim 12 wherein each of the segments has a convex outer wall that forms a portion of the outer surface of the overpack body and a concave inner wall that forms a portion of the inner surface of the overpack body; and wherein the convex outer walls of the curved segments lie in a first reference cylinder and the concave inner walls of the curved segments lie in a second reference cylinder that is concentric to the first reference cylinder.

* * * * *